US006851421B2

(12) United States Patent
Livchak et al.

(10) Patent No.: US 6,851,421 B2
(45) Date of Patent: Feb. 8, 2005

(54) EXHAUST HOOD WITH AIR CURTAIN

(75) Inventors: Andrey Livchak, Bowling Green, KY (US); Philip Meredith, Bowling Green, KY (US)

(73) Assignee: Halton Company, Scottsville, KY (US)

( * ) Notice: Subject to any disclaimer, the term of this patent is extended or adjusted under 35 U.S.C. 154(b) by 0 days.

(21) Appl. No.: 10/168,815

(22) PCT Filed: Jan. 10, 2001

(86) PCT No.: PCT/US01/00770

§ 371 (c)(1),
(2), (4) Date: May 5, 2003

(87) PCT Pub. No.: WO01/51857

PCT Pub. Date: Jul. 19, 2001

(65) Prior Publication Data

US 2004/0011349 A1 Jan. 22, 2004

Related U.S. Application Data

(60) Provisional application No. 60/175,208, filed on Jan. 10, 2000.

(51) Int. Cl.[7] ..... F24C 15/20
(52) U.S. Cl. ..... 126/299 D; 126/299 R
(58) Field of Search ..... 126/299 R, 299 D; 454/67; 55/DIG. 36

(56) References Cited

U.S. PATENT DOCUMENTS

| | | | | | |
|---|---|---|---|---|---|
| 3,400,649 | A | | 9/1968 | Jensen | |
| 3,513,766 | A | * | 5/1970 | Ahlrich | 126/299 D |
| 4,043,319 | A | | 8/1977 | Jensen | |
| 4,047,519 | A | | 9/1977 | Nett | |
| 4,050,368 | A | | 9/1977 | Eakes | |
| 4,085,736 | A | * | 4/1978 | Kuechler | 126/299 D |
| 4,127,106 | A | | 11/1978 | Jensen | |
| 4,134,394 | A | | 1/1979 | Otenbaker | |
| 4,153,044 | A | | 5/1979 | Nett | |
| 4,346,692 | A | | 8/1982 | McCauley | |
| 4,475,534 | A | | 10/1984 | Moriarty | |
| 4,483,316 | A | | 11/1984 | Fritz et al. | |
| 4,484,563 | A | | 11/1984 | Fritz et al. | |
| 4,556,046 | A | | 12/1985 | Riffel et al. | |
| 4,586,486 | A | | 5/1986 | Kaufman | |
| 4,655,194 | A | | 4/1987 | Wooden | |
| 4,811,724 | A | | 3/1989 | Aalto et al. | |
| 5,050,581 | A | | 9/1991 | Röhl-Hager et al. | |
| 5,251,608 | A | | 10/1993 | Cote | |
| 5,522,377 | A | | 6/1996 | Fritz | |
| 6,044,838 | A | * | 4/2000 | Deng | 126/299 D |
| 6,058,929 | A | * | 5/2000 | Fritz | 126/299 R |

FOREIGN PATENT DOCUMENTS

| | | | | | |
|---|---|---|---|---|---|
| CH | 68512 | | | 9/1993 | |
| JP | 03247937 | A | * | 11/1991 | 126/299 D |
| WO | WO 0184054 | A1 | * | 11/2001 | |
| WO | 03/056252 | | | 7/2003 | |

* cited by examiner

*Primary Examiner*—Sara Clarke
(74) *Attorney, Agent, or Firm*—Proskauer Rose LLP

(57) ABSTRACT

An exhaust hood (125, 225, 325, 425) captures and contains a thermal plume (170, 370, 470) with a minimum of exhaust air by defining a short-throw vertical curtain jet (150, 350, 453) around a protected perimeter. The jet augments the formation of a vortex (135, 335) within the hood which extends beyond the hood protected by the curtain jet. The effect is the extension of the buffer volume of the hood recess. This reduces the fluid strain that generates the turbulent eddies that cause breach of containment. Also, the curtain jet augments the vortical flow which is stable and contains less fluid strain than would otherwise occur. The hood recess is shaped to assist in defining the above vortex in terms of both its shape and its size. For example, the recess may be made smooth-walled according to an aspect of the invention.

19 Claims, 7 Drawing Sheets

EXHAUST HOOD WITH AIR CURTAIN

This is a National Stage application of International Application No. PCT/US01/00770, filed Jan. 10, 2001 which claims the benefit of U.S Provisional Application No. 60/175,208, filed Jan. 10, 2000.

FIELD OF THE INVENTION

The present invention relates to an exhaust hood that employs an air curtain jet in combination with a hood geometry to enhance capture efficiency by channeling flow through a space narrowed by the air curtain with augmentation of a vortical flow confined by the hood and creation of a buffer zone defined by the combination of the hood interior and air curtain jet.

DESCRIPTION OF THE RELATED ART

Exhaust hoods for ventilation of pollutants from kitchen appliances, such as ranges, promote capture and containment by providing a buffer zone above the pollutant source where buoyancy-driven momentum transients can be dissipated before pollutants are extracted. By managing transients in this way, the effective capture zone of an exhaust supply can be increased.

Basic exhaust hoods use an exhaust blower to create a negative pressure zone to draw effluent-laden air directly away from the pollutant source. In kitchen hoods, the exhaust blower generally draws pollutants, including room-air, through a filter and out of the kitchen through a duct system. An exhaust blower, e.g., a variable speed fan, contained within the exhaust hood is used to remove the effluent from the room and is typically positioned on the suction side of a filter disposed between the pollutant source and the blower. Depending on the rate by which the effluent is created and the buildup of effluent near the pollutant source, the speed of exhaust blower may be manually set to minimize the flow rate at the lowest point which achieves capture and containment.

Referring to FIG. 1, a typical prior art exhaust hood 90 is located over a range 15. The exhaust hood 90 has a recess 55 with at least one vent 65 (covered by a filter 60) and an exhaust duct 30 leading to an exhaust system (not shown) that draws off contaminated air 45. The vent 65 is an opening in a barrier 35 defining a plenum 37. The exhaust system usually consists of external ductwork and one or more fans that pull air and contaminants out of a building and discharge them to a treatment facility or simply into the atmosphere. The recess 55 of the exhaust hood 90 plays an important role in capturing the contaminant because heat, as well as particulate and vapor contamination, is usually produced by the contaminant-producing processes. The heat causes its own thermal convection-driven flow or plume 10 which must be captured by the hood within its recess 55 while the contaminant is steadily drawn out of the hood. The recess creates a buffer zone to help insure that transient convection plumes do not escape the steady exhaust flow through the vent. The convection-driven flow or plume 10 may form a vortical flow pattern 20 due to the Coanda effect, which causes the thermal plume 10 to cling to the back wall. The exhaust rate in all practical applications is such that room air 5 is drawn off along with the contaminants.

In reality, the vortical flow pattern 20 is not well-defined. The low flow velocities and fluid strain scatter the mean flow energy into a distribution of turbulent eddies. These create flow transients 76 which may escape the mean flow 77 from the conditioned space into the suction field of the hood. Such transients are also caused by pulses in heat and gas volume such as surges in steam generation or heat output. The problem is one of a combination of overpowering the strong buoyancy-driven flow using a high exhaust and buffering the flow so that a more moderate exhaust can handle the surges in load.

But basic hoods and exhaust systems are limited in their abilities to buffer flow. The exhaust rate required to achieve full capture and containment is governed by the highest transient load pulses that occur. This requires the exhaust rate to be higher than the average volume of effluent (which is inevitably mixed with entrained air). Such transients can be caused by gusts in the surrounding space and/or turbulence caused by the plug flow (the warm plume of effluent rising due to buoyancy). Thus, for full capture and containment, the effluent must be removed through the exhaust blower operating at a high enough speed to capture all transients, including the rare pulses in exhaust load. Providing a high exhaust rate—a brute force approach—is associated with energy loss since conditioned air must be drawn out of the space in which the exhaust hood is located. Further, high volume operation increases the cost of operating the exhaust blower and raises the noise level of the ventilation system. Thus, there is a perennial need for ways of improving the ability of exhaust hoods to minimize entrained air and to buffer transient fluctuations in exhaust load.

One technique described in the prior art involves the use of a source of "make up" air. The make-up is unconditioned air that is propelled toward the exhaust blower. This "short circuit" system involves an output blower that supplies and directs one, or a combination of, conditioned and unconditioned air toward the exhaust hood and blower assembly. The addition of an output blower creates a venturi effect above the cooking surface, which forces the effluent, heat, grease, and other particles toward the exhaust hood.

Such "short circuit" systems have not proven to reduce the volume of conditioned air needed to achieve full capture and containment under a given load condition. In reality, a short circuit system may actually increase the amount of conditioned air that is exhausted. To operate effectively, the exhaust blower must operate at a higher speed due to the need to remove not only the effluent-laden air but also to remove the make-up air. Make-up air may also increase turbulence in the vicinity of the effluent source, which may increase the volume of conditioned air that is entrained in the effluent, thereby increasing the amount of exhaust required.

Another solution in the prior art is described in U.S. Pat. No. 4,475,534 titled "Ventilating System for Kitchen." In this patent, the inventor describes an air outlet in the front end of the hood that discharges a relatively low velocity stream of air downwardly. According to the description, the relatively low velocity air stream forms a curtain of air to prevent conditioned air from being drawn into the hood. In the invention, the air outlet in the front end of the hood assists with separating a portion of the conditioned air away from the hood. Other sources of air directed towards the hood create a venturi effect, as described in the short circuit systems above. As diagramed in the figures of the patent, the exhaust blower must "suck up" air from numerous air sources, as well as the effluent-laden air. Also the use of a relatively low velocity air stream necessitates a larger volume of air flow from the air outlet to overcome the viscous effects that the surrounding air will have on the flow.

In U.S. Pat. No. 4,346,692 titled "Make-Up Air Device for Range Hood," the inventor describes a typical short circuit system that relies on a venturi effect to remove a substantial portion of the effluent. The patent also illustrates the use of diverter vanes or louvers to direct the air source in a downwardly direction. Besides the problems associated with such short circuit systems described above, the invention also utilizes vanes to direct the air flow of the output blower. The use of vanes with relatively large openings, through which the air is propelled, requires a relatively large air volume flow to create a substantial air velocity output. This large, air volume flow must be sucked up by the exhaust blower, which increases the rate by which conditioned air leaves the room. The large, air volume flow also creates large scale turbulence, which can increase the rate by which the effluent disperses to other parts of the room.

SUMMARY OF THE INVENTION

Effluent is extracted from pollutant sources in a conditioned space, such a kitchen, by a hood whose effective capture and containment capability is enhanced by the user of air curtain jets positioned around the perimeter of the hood. The particular range of velocities, positioning, and direction of the jets in combination with a shape of the hood recess, are such as to create a large buffer zone below the hood with an extended vortical flow pattern that enhances capture.

By positioning a series of jets on or near the exhaust hood and by directing the jets toward the (heated) pollutant source, the air jets confine the entry of conditioned air into the exhaust stream to an effective aperture defined by the terminus of the air curtain. The curtain flows along a tangent of the vortical flow pattern, part of which is within the canopy recess and part of which is below it and confined and augmented by the curtain. The large volume defined by the canopy interior, extended by the jets, creates a large buffer zone to smooth out transients in plug flow. The enhanced capture efficiency permits the exhaust blower to operate at a slower speed while enforcing full capture and containment. This in turn minimizes the amount of conditioned air that must be extracted with a concomitant reduction in energy loss.

One aspect of the invention involves the shape of the exhaust hood. The hood is shaped such that the stack effect of the heated, effluent-laden air and the positioning and direction of the air jets creates a vortex under the hood. The hood is preferably shaped so that its lower surface—the outer surface closest to the cooking surface—is smooth and rounded, thereby reducing the number and size of the dead air pockets that reside under the hood. Corners can create dead pockets of air, which affect the direction and speed of the air flow. The bulk flow due to buoyancy of the heated pollutant stream creates a first airflow in an upward direction. The air jets create a second airflow directed downwardly and offset from the first air flow. Between these two patterns, a vortical flow arises which is sustained by them. This stable vortical flow minimizes the strain of the mean flow of the curtain which reduces entrainment of room air into the curtain. In addition, the curtain defines a smaller aperture for the flow of conditioned air into the exhaust stream thereby causing it to have a higher velocity, which in turn enhances the capture effect.

Another aspect of the invention involves the configuration of the air jets. The ideal configuration is dependent upon a number of factors, including the size of the cooking assembly, the cooking environment, and certain user preferences. Although the dependency on the numerous factors may change the ideal configuration from one environment to the next, following certain principles, which are described below, increase the efficiency of the system.

Multiple jets that have nozzles with smaller diameters and that propel air at a higher velocity are generally more effective than a single jet with one long and narrow nozzle or even multiple jets with much larger nozzles. The effectiveness of the air jets depends, in large part, on its output velocity. Air jets with larger nozzles must discharge air at a faster rate to achieve a comparable output velocity. Jets with lower output velocities create an air flow that dissipates more quickly due to loss of momentum to viscosity and may have a throw that is only a short distance from the nozzle.

On the other hand, smaller nozzles generally produce much smaller scale turbulence and tend to disturb the thermal flow created by the cooking surface to a lesser degree than larger scale turbulence. Smaller nozzles also require less air. Because of the lesser amount of air that is needed for the air jets, the air jets can propel conditioned air, unconditioned air, or a mixture of the two. The use of conditioned air is preferable and eliminates the need for the air jets to have access to an outside source of air. The use of conditioned air also provides additional benefits. For example, on a cold day, the use of unconditioned air may cause discomfort to the chef who is working under the cold air jets or may subject the cooking food to cold, untreated and particle-carrying air. The use of cold, unconditioned air may also affect the thermal flow of the effluent-laden air by creating or highlighting an undesired air flow pattern due to the temperature differences between the air jet air and the effluent-laden air.

The invention will be described in connection with certain preferred embodiments, with reference to the following illustrative figures so that it may be more fully understood.

With reference to the figures, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail that is necessary for a fundamental understanding of the invention, the description taken with the drawings making apparent to those skilled in the art how the several forms of the invention may be embodied in practice.

DETAILED DESCRIPTION OF THE DRAWINGS

Figure 2:
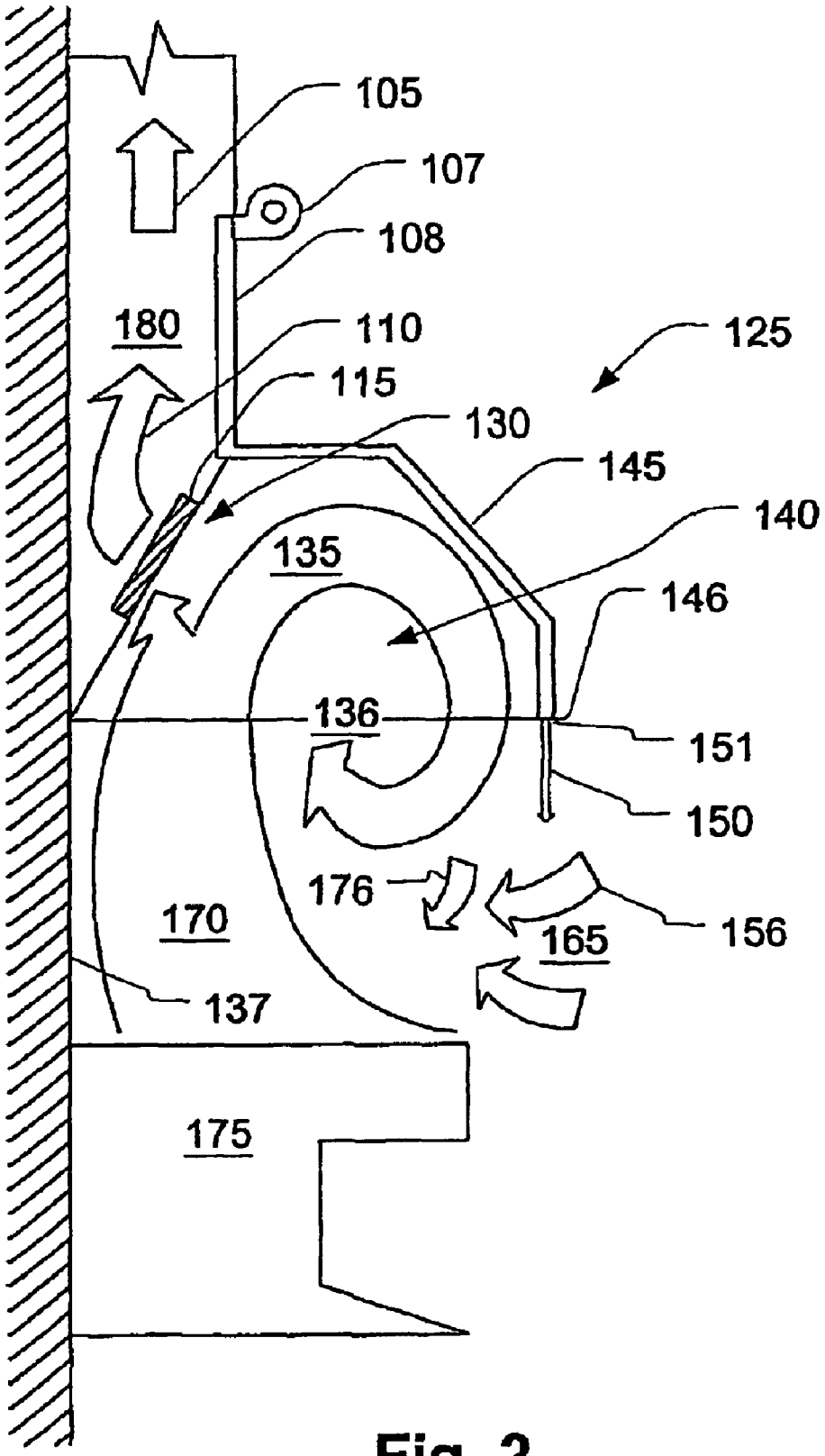
FIG. 2 is a cross-sectional representation of a wall-canopy style kitchen exhaust hood according to an embodiment of the invention.

Referring now to FIG. 2, effluent produced when food is cooked on a grill 175 creates a plume 170 that rises into a canopy recess 140. The recess 140 may be shaped to have a faceted or curved interior face to reduce resistance to a vortical flow 135. Grease or other particulates may be removed by an air filter 115, located in an exhaust vent 130 inside the canopy recess 140.

In the current embodiment, a planar curtain jet 150 is generated by injecting room air downwardly from a forward edge 141 of the canopy 145 through apertures (not visible) in a horizontal face of the forward edge 141. The forward edge 141 jet 150 may be fed from a duct 108 integral to the canopy 145. Individual jets 151 are directed substantially vertically downward and spaced apart such that they coalesce into the planar curtain jet 150 a short distance from the nozzles from which they originate. The source of the conditioned air may be conditioned space or another source such as make-up air or a combination of make-up and conditioned air. Although not illustrated, the exhaust assembly 10 can also be designed with the curtain jet 150 directed downwardly but in a direction that is tilted toward a space 136 between the jet 150 and a back wall 137. The various individual jets 151 may be re-configurable to point in varying directions to permit their combined effect to be optimized.

During operation, pollutants are carried upwardly by buoyancy forming a flow 170 that attaches (due to the Coanda effect) to a rear bounding wall 137 due to the no flow boundary condition. The mass flow of flow 170 is higher than a mean mass flow attributable to the exhaust rate and the extra energy is dissipated in the canopy recess 140 as a turbulent cascade of successively smaller scale vortices of which the largest is vortical flow 135. In other words, the excess energy of the buoyancy-driven flow is captured within the canopy recess 140 and released to a successively smaller eddies until its energy is lost to viscous friction.

Figure 1:
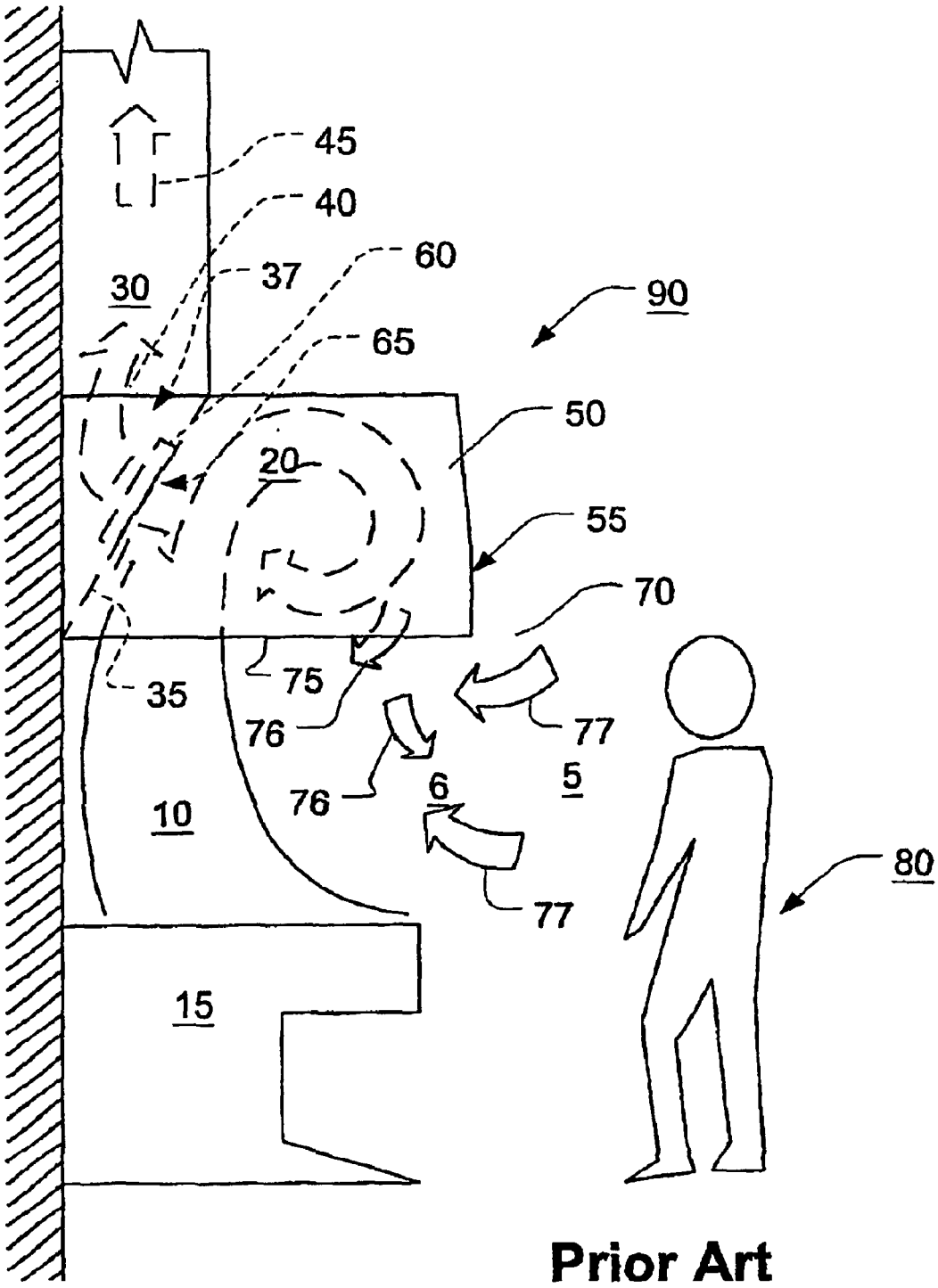
FIG. 1 is a cross-sectional representation of a canopy style kitchen exhaust hood according to the prior art.

In prior art systems, the vortex 135 and turbulent cascade are associated with chaotic velocity fluctuations which, at the larger scales, can result in transient and repeated reverse flows 76 (See FIG. 1) that result in escape of effluent unless they are overwhelmed by the exhaust flow rate. In the embodiment of FIG. 2, the curtain jet 150 forces the air being drawing from the room 156 into a narrower channel 165 than the corresponding channel 6 of the prior art system. Thus, the mean velocity of the flow from the room into the exhaust stream is higher and better able to overwhelm the transient reverse flows 176 associated with turbulent energy dissipation in the hood recess 140.

An additional advantageous effect is associated with the curtain jet 150 and hood recess 140 combination. The curtain jet 150 helps to define a larger effective buffer zone 136 than the canopy recess 140 alone. Because the vortex 135 is larger, the fluid strain rate associated with it is smaller thereby producing lower velocity turbulent eddies and concomitant random and reverse flows 176. The strain rate is further reduced by the moving boundary condition along the inside surface of the jet 150, which is moving rather than a stationary air mass outside the hood.

Preferably, the jet 150 is designed to propel air at such velocity and width that the downwardly directed air flow dissipates before getting too close to the range 175. In other words, the jet's "throw" should not be such that the jet reaches the Coanda plume 170. Otherwise, the Coanda flow plume 170 will be disrupted causing turbulent eddies and possible escape of pollutants.

Figure 3:
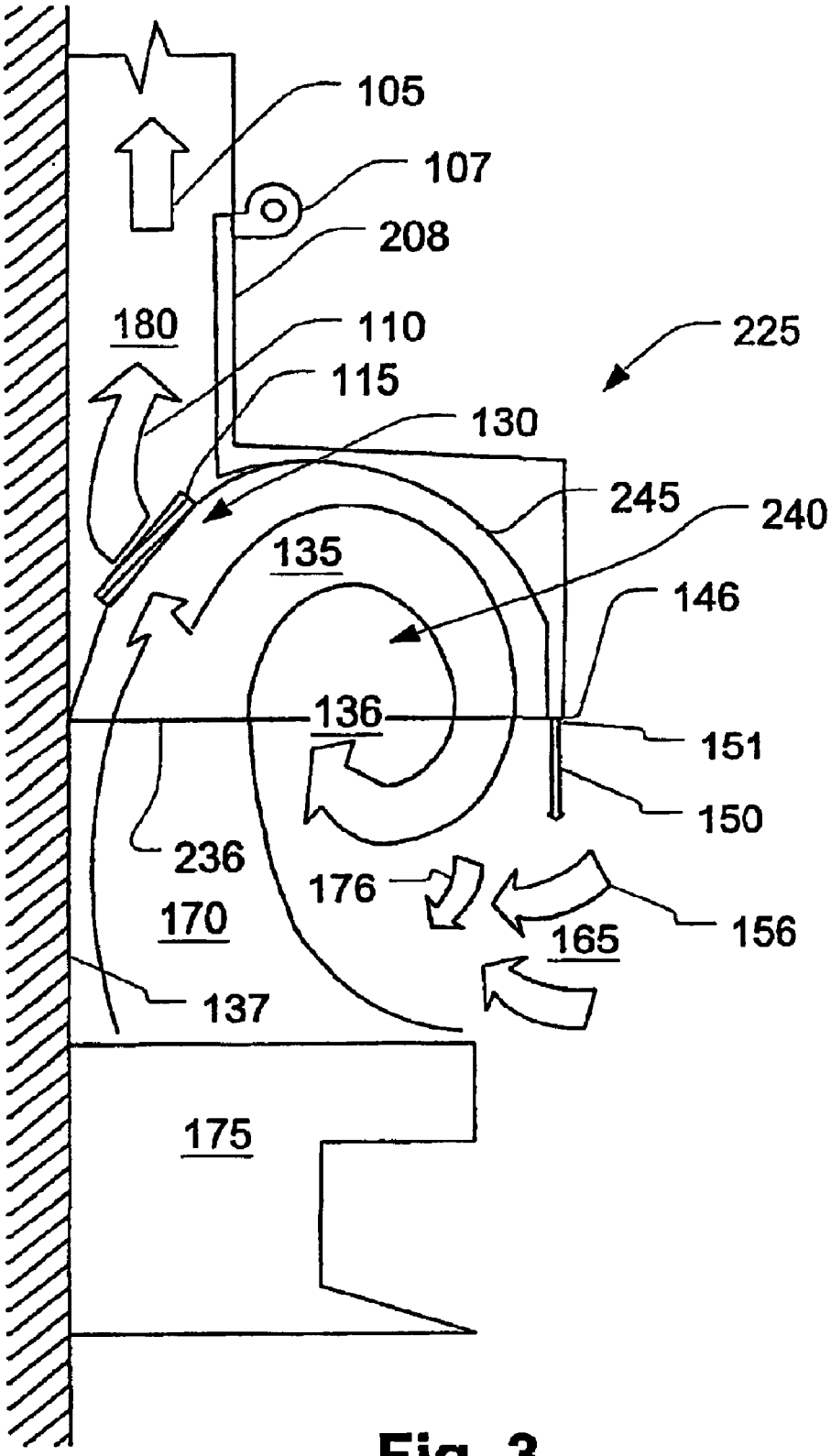
FIG. 3 is a cross-sectional representation of a wall-canopy style kitchen exhaust hood according to another embodiment of the invention.

Referring now to FIG. 3, In an alternative embodiment, an exhaust hood 225 is shaped such that the walls of its recess 240 surface form a smooth curve to reduce resistance to the 135 vortex. A recess containing sharp changes in profile and/or recesses, (e.g., a corner), creates turbulence, which can impede the vortex 135.

To enhance and prevent leakage from the sides, panels 236 are located on the sides, thereby preventing effluent from escaping where the panels 236 are present. Alternatively, the curtain jets 150 may extend around the entire exposed perimeter of the hood 240.

Figure 4:
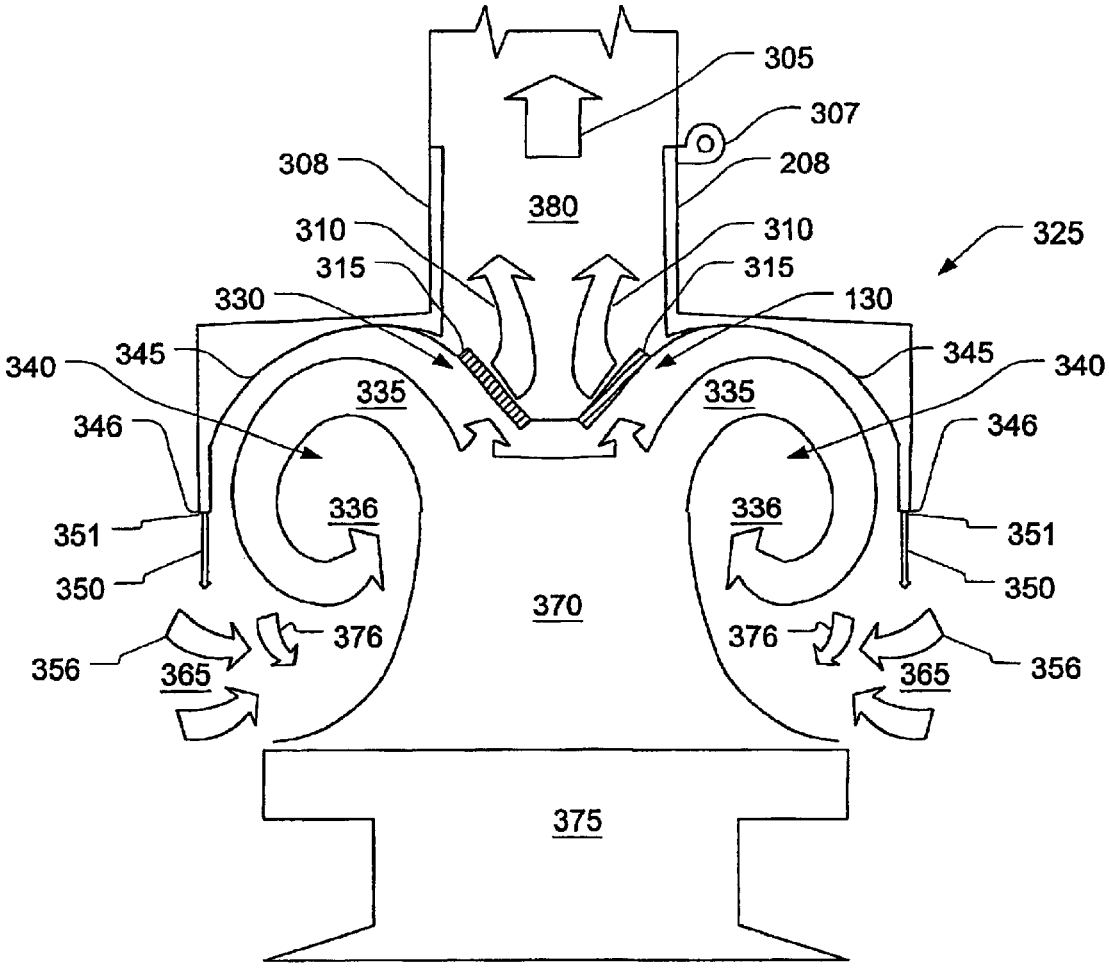
FIG. 4 is a cross-sectional representation of an island-canopy style kitchen exhaust hood according to another embodiment of the invention.

Referring now to FIG. 4, an island pollutant source such as a grill 375 is open on four sides. Curtain jets 350 are generated around an entire perimeter of an exhaust hood 325. The filters 315 are arranged in a pyramidal structure or wedge-shaped, according to designer preference. The depth (dimension into the plane of the figure) of the hood 325 is arbitrary. In this case, the thermal plume 370 does not attach to a surface and forms a free-standing plume 370. Vortices 335 form in a manner similar to that discussed above with respect to the wall-mounted canopy hoods 125 and 225.

Figure 5:
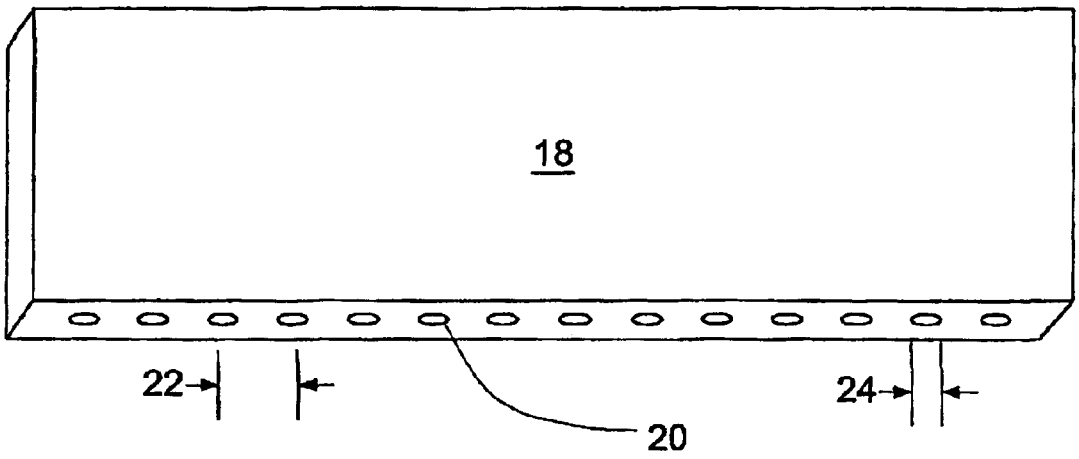
FIG. 5 is an isometric view of a panel of an exhaust hood with a series of jets to form a curtain jet.

Referring now to FIG. 5, which show two different perspectives of an arrangement of the air nozzles 20, each nozzle 20 is separated by a distance 22 and positioned to form a substantially straight line across the front of the exhaust hood 18. The nozzles 20 are spaced apart from each other such that they form individual jets which combine into a curtain jet 15/350 which is two dimensional. This occurs because the jets expand due to air entrainment and coalesce a short distance from the nozzles 20. In a preferred embodiment, each of the nozzles 20 has an orifice diameter 24 of approximately 6.5 mm, and combined, the jets 20 have an initial velocity of approximately 9 $ft^3$/min/linear ft. (The "linear ft." length refers to the length of the edge along which the jet generated.) Preferably, the range is between 3 and 15 $ft^3$/min/linear ft. The velocity of the jet, of course, diminishes with distance from the nozzles 20. The initial velocity and jet size should be such that the jet velocity is close to zero by the time it reaches the plume 170/370. Alternatively, the jet 150/150 should be directed in such a direction that its effect is not disruptive to the plume, for example, by directing the jet outwardly away from the hood recess 140/340. In fact, in an island application, because of cross-drafts in the conditioned space, there may be a need to form a more robust curtain jet 350 to protect the plume 370. In such a case, the overhang (the position of the perimeter of the hood, in a horizontal dimension, from the outermost edge of the pollutant source 375) and direction of the jet 350 may be made such that there is little or no disruption of the plume due to the jet 350. Note that the nozzles 20 may simply be perforations in a plenum defined by the front section 18 of the exhaust hood. Alternatively, they may be nozzle sections with a varying internal cross section that minimizes expansion on exit. The nozzles may contain flow conditioners such as settling screens and/or or flow straighteners.

Figure 6:
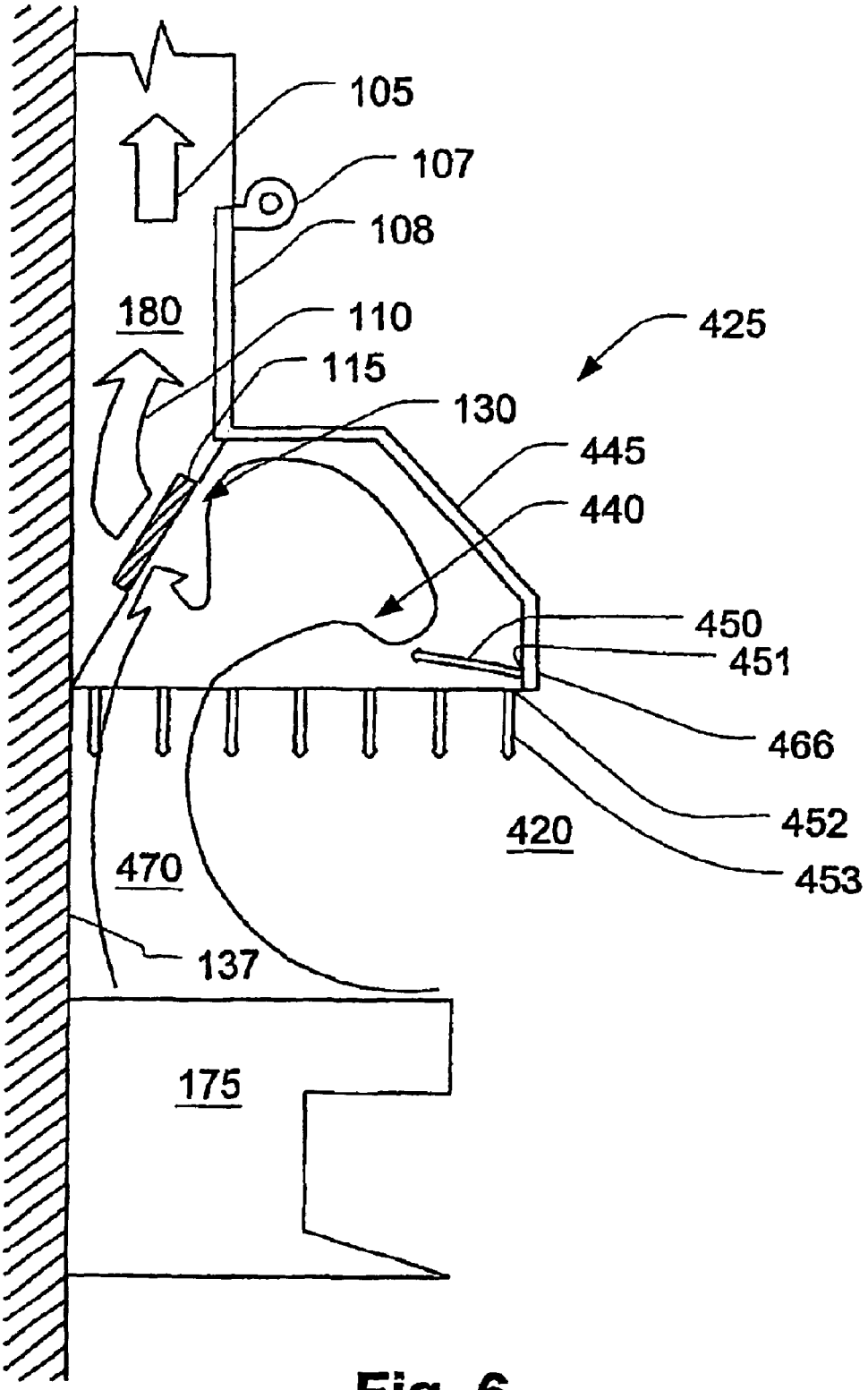
FIG. 6 is a cross-sectional representation of a wall-canopy style hood with vertical and horizontal jets to augment capture and containment according to still another embodiment of the invention.

Referring now to FIG. 6 as in the previous embodiments, a source of pollutants, such as a grill 175 generates a hot effluent plume 175. A nozzle arrangement producing a prior art type of capture augmentation jet 451 is produced along the forward edge 466 of a canopy hood 425. The nozzles are arrange to form a planar jet as discussed with respect to the curtain jets 150/350 of previous embodiments. This horizontal jet 450 pushes the plume 470 toward the exhaust vent 130. It also creates a negative pressure field around the forward edge 466 of the hood 425 which helps containment. The prior art configuration, however, suffers from spillage of the effluent plume 470 from the sides of a canopy 425. According to the invention, a side curtain jet 452 may be used in concert with the capture augmentation jet 451 to ameliorate the spillage problem. The side curtain jet works in a manner as described above with respect to the earlier embodiments. That is, it forces exhausted air from the surrounding conditioned space to flow through a narrower effective aperture thereby providing greater capacity to overcome fluctuating currents with a lower volume exhaust rate than would otherwise be required. In an alternative embodiment, the side curtain jet is tilted inwardly to push the plume toward the center of the canopy recess 440.

Figure 7:
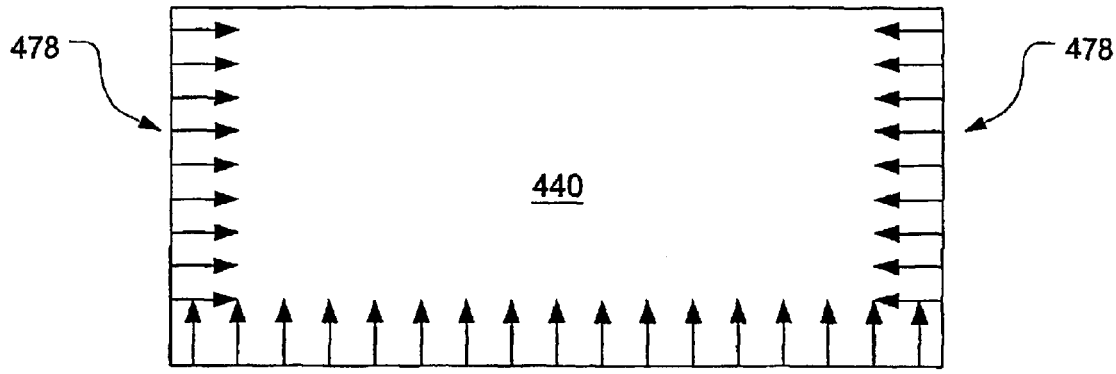
FIGS. 7–9 are plan views of various jet patterns according to embodiments of the invention.
Figure 8:
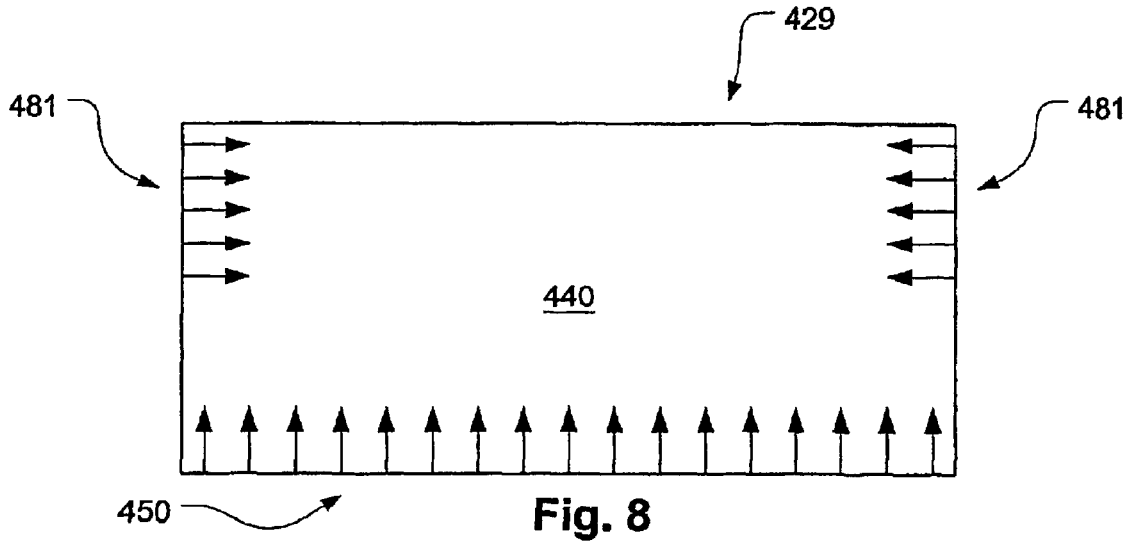
Figure 9:
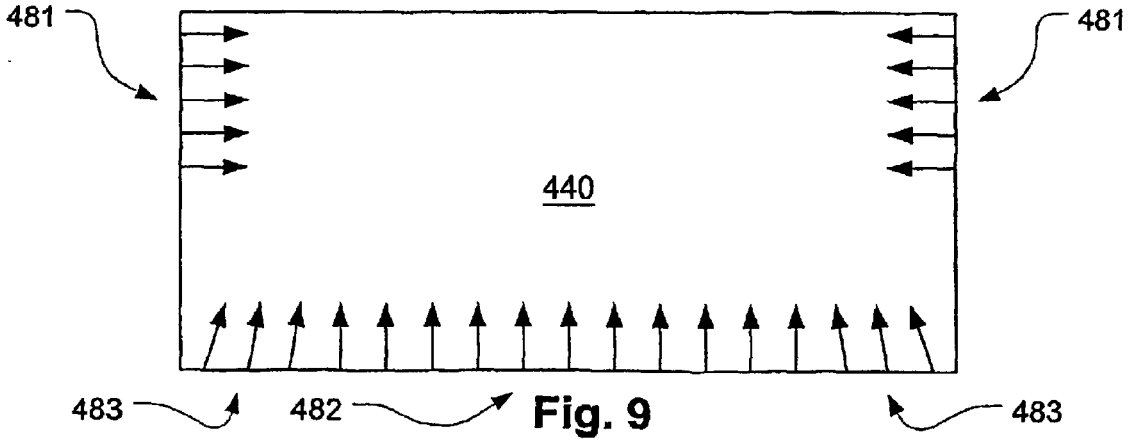

Referring to FIG. 7 in another alternative embodiment, a horizontal capture augmentation jet 478 is generated around the entire perimeter of the hood 429 rather than forming a vertical curtain jet 453. Referring to FIG. 8 in still another embodiment, the capture augmentation jet 481 extends only partly along the sides with a full capture augmentation jet 450 across the forward edge of the hood. Referring to FIG. 9 in yet another embodiment the forward edge capture jet 482 is formed by individual jets. The ones at the corners 483 are directly toward the center as indicated. This helps to prevent side spillage.

It will be evident to those skilled in the art that the invention is not limited to the details of the foregoing illustrative embodiments, and that the present invention may be embodied in other specific forms without departing from the spirit or essential attributes thereof. For example, while in the embodiments described above, curtain jets were formed using a series of round nozzles, it is clear that it is possible to form curtain jets using a single slot or non-round nozzles. Also, the source of air for the jets may be room air, outdoor air or a combination thereof. The invention is also applicable to any process that forms a thermal plume, not just a kitchen range. Also, the principles may be applied to back shelf hoods which have no overhang as well as to the canopy style hoods discussed above. Also, we note that although in the above embodiments, the hood and vortex were discussed in terms of a cylindrical vortex, it is possible to apply the same invention to multiple cylindrical vortices joined at an angle at their ends such as to define a single toroidal vortex for an island canopy. The torus thereby formed could also be rectangular for low aspect-ratio island hoods. Still further, in consideration of air curtain principles, it would be possible to direct the curtain jets outwardly while still providing the described benefits. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. An apparatus for removing cooking effluent from a cooking appliance in a conditioned space, said cooking effluent being such as to tend to rise by buoyancy effect as a plume, said apparatus comprising:

an exhaust hood defining a recess with an access positioned above said cooking appliance;

a wall of said recess being shaped to define at least one curved wall;

said wall having an exhaust vent;

said exhaust hood being positioned above said cooking appliance such that said plume rises into said recess and bends along said curved wall approximately 180 degrees;

said hood having a duct therein to form a jet at at least one edge of said hood closest to said appliance, said jet being substantially vertical and being substantially planar in shape;

a direction and position of said jet and a shape and position of said recess being such that said plume curving along said wall flows into a vortex and exchanges momentum from said jet, such that the vortex is partly within the canopy recess and partly below it and is confined and augmented by the jet.

2. An apparatus as in claim 1 wherein said hood has a fan configured to feed air from a conditioned apace when said hood is located in said conditioned space, whereby said jet is made of conditioned air.

3. An apparatus as in claim 1, wherein said planar jet is formed by a coalescence of multiple round jets.

4. An apparatus as in claim 1, wherein, said hood is rectangular in plan view and said at least one edge is a perimeter surrounding at least two sides of said hood, whereby said planar jet is formed along said at least two aides.

5. An apparatus for removing cooking effluent from a cooking appliance in a conditioned space, said cooking effluent being such as to tend to rise by buoyancy effect as a plume, said apparatus comprising:

an exhaust hood defining a recess with an access positioned above said cooking appliance;

a wall of said recess being shaped to define at least one curved wall; said wall having an exhaust vent;

said exhaust hood being positioned above said cooking appliance such that said plume rises into said recess and bends along said curved wall approximately 180 degrees;

said hood having a duct therein to form a jet at at least one edge of said hood closest to said appliance, said jet being substantially vertical and being substantially planar in shape;

a direction an position of said jet and a shape and position of said recess being such that said plume curving alone said wall flows into a vortex and exchanges momentum from said jet, wherein said jet is such that a velocity thereof reaches less than 0.3 m./sec. at a point above said plume, whereby said jet does not substantially disturb said plume.

6. An apparatus for removing cooking effluent from a cooking appliance in a conditioned space, said cooking effluent being such as to tend to rise by buoyancy effect as a plume, said apparatus comprising:

an exhaust hood defining recess with an access positioned above said cooking appliance;

a wall of said recess being shaped to define at least one curved wall; said wall having an exhaust vent;

said exhaust hood being positioned above said cooking appliance such that said plume rises into said recess and bends along said curved wall approximately 180 degrees;

said hood having a duct therein to form a jet at least one edge of said hood closest to said appliance, said jet being substantially vertical and being substantially planar in shave;

a direction and position of said jet and a shape and position of said recess being such that said plume curving alone said wall flows into a vortex and exchanges momentum from said jet, wherein said jet is fed by a flow of less than 10 ft3/min per linear foot of said at least one edge along which said jet is formed.

7. An apparatus for removing cooking effluent from a cooking appliance in a conditioned space, said cooking effluent being such as to tend to rise by buoyancy effect as a plume, said apparatus comprising:

an exhaust hood defining a recess with an access positioned above said cooking appliance;

a wall of said recess being shaped to define at least one curved wall; said wall having an exhaust vent;

said exhaust hood being positioned above said cooking appliance such that said plume rises into said recess and bends along said curved wall approximately 180 degrees;

said hood having a duct therein to form a let at at least one edge of said hood closest to said appliance, said jet being substantially vertical and being substantially planar in shape;

a direction and position said jet and a share and position of said recess being such that said plume curving along said wall flows into a vortex and exchanges momentum from said jet, wherein said hood is configured to form a further jet from another edge facing said appliance, said further jet being horizontally directed.

8. An apparatus for removing cooking effluent from a cooking appliance in a conditioned space, said cooking effluent being such as to tend to rise by buoyancy effect as a plume, said apparatus comprising:

an exhaust hood defining a recess with an access positioned above said cooking appliance;

a wall of said recess being shaped to define at least one curved wall; said wall having an exhaust vent;

said exhaust hood being positioned above said cooking appliance such that said plume rises into said recess and bends along said curved wall approximately 180 degrees;

said hood having a duct therein to form a jet at at least one edge of said hood closest to said appliance, said jet being substantially vertical and being substantially planar in shape;

a direction and position of said jet and a shape and position of said recess being such that said plume curving along said wall flows into a vortex and exchanges momentum from said jet, wherein said recess wall defines two cylindrical surfaces.

9. A kitchen exhaust hood, comprising: a canopy having a recess and an access, said recess being substantially cylindrical in cross-section; said canopy containing a duct and openings in communication with said duct, said openings facing in a direction substantially perpendicular to a plane of said access and away from said recess such that air ejected from said openings form jets directed in said direction; at least some of said openings being spaced apart such as would cause said jets coalesce less than ten diameters of said openings away from said openings with a jet of at least one other of said openings; said openings having diameters of less than 2 cm, whereby said jet formed thereby may be thin enough to have a throw not greater than 1 M. despite an initial velocity of greater than 1 m./sec.

10. A hood as in claim 9 wherein said recess defines a piecewise-cylindrical wall with at least three planar segments.

11. A hood as in claim 9 wherein said recess defines a smooth cylindrical wall.

12. A hood as in claim 9, wherein: at least some of said jets are arranged along a straight line; said jet is fed by a flow of between 3 and 15 ft3 per minute per linear foot of said straight line.

13. A hood as in claim 9, wherein said hood has further openings facing said recess such as to produce jets directed parallel to said access, said further openings being on at least one edge of said hood that is perpendicular to and edge along which said openings are located.

14. A kitchen exhaust hood, comprising: a canopy with a recess and an access said recess being smoothly shaped to direct a thermal plume around a single bend to form a vortex; said canopy being configured to form a curtain jet along a tangent to said vortex; said curtain jet being formed by a volume flow of between 3 and 15 ft3/min/linear ft.

15. An apparatus for removing cooking effluent from a cooking appliance in a conditioned space, said cooking of effluent being such as to tend to rise by buoyancy effect as a plume, said apparatus comprising:

an exhaust hood defining a recess with an access positioned above said cooking appliance;

an exhaust vent located in an interior of said recess;

said exhaust hood being positioned above said cooking appliance such that said plume rises into said recess;

said hood having a duct therein to form a jet at at least one edge of said hood closest to said appliance, said jet being substantially vertical and being substantially planar in shape;

a shape of said recess and a direction and position of said jet being such that a vortex is formed within said recess that extends below said at least one edge;

the vortex being substantially bounded by the recess and at least a portion of said jet, whereby the downward momentum of said jet augments said vortex.

16. An apparatus as in claim 15, wherein said jet is such that a velocity thereof reaches a velocity of less than 0.3 m./sec. at a point above said plume, whereby said jet does not substantially disturb said plume.

17. An apparatus as in claim 15, wherein said jet is fed by a flow of less than 10 ft3/ min per linear foot of said at least one edge along which said jet is formed.

18. An apparatus as in claim 15, wherein said planar jet is formed by a coalescence of multiple round jets.

19. An apparatus as in claim 15, wherein said hood is rectangular in plan view and said at least one edge is a perimeter surrounding at least two sides of said hood, whereby said planar jet is formed along said at least two sides.

* * * * *